US007738816B2

(12) United States Patent
Sakita et al.

(10) Patent No.: US 7,738,816 B2
(45) **Date of Patent: *Jun. 15, 2010**

(54) IMAGE FORMING APPARATUS FOR SUPPLYING TONER FROM ONE OF A PLURALITY OF TONER CARTRIDGES

(75) Inventors: Hirofumi Sakita, Nara (JP); Hideyuki Nishimura, Osaka (JP); Hisaaki Kobayashi, Nara (JP); Hirokazu Izumi, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 840 days.

This patent is subject to a terminal disclaimer.

(21) Appl. No.: 11/519,289

(22) Filed: Sep. 11, 2006

(65) Prior Publication Data

US 2007/0058997 A1 Mar. 15, 2007

(30) Foreign Application Priority Data

Sep. 12, 2005 (JP) ..... P2005-264090

(51) Int. Cl.
*G03G 15/08* (2006.01)

(52) U.S. Cl. ..... 399/258; 399/27

(58) Field of Classification Search ..... 399/24, 399/27, 258, 262, 226, 227
See application file for complete search history.

(56) References Cited

U.S. PATENT DOCUMENTS

| | | | | |
|---|---|---|---|---|
| 5,585,899 | A * | 12/1996 | Palumbo et al. | 399/258 |
| 6,097,903 | A * | 8/2000 | Yahata et al. | 399/27 |
| 6,795,660 | B2 | 9/2004 | Yugeta et al. | |
| 2006/0008299 | A1 * | 1/2006 | Amano et al. | 399/262 |

FOREIGN PATENT DOCUMENTS

| | | |
|---|---|---|
| JP | 08-137227 | 5/1996 |
| JP | 2003-208007 | 7/2003 |
| JP | 2004-109367 | 4/2004 |
| JP | 2005-316230 | 11/2005 |

* cited by examiner

*Primary Examiner*—David M Gray
*Assistant Examiner*—Laura K Roth
(74) *Attorney, Agent, or Firm*—Edwards Angell Palmer & Dodge LLP; David G. Conlin; Steven M. Jensen

(57) ABSTRACT

An image forming apparatus capable of selecting a toner cartridge from a plurality of toner cartridges containing toner of an identical color preferentially without interrupting an image forming action of the apparatus. When a toner density of the toner in a developer container becomes low, a control section drives a toner supply section in response to information on the remaining amount of the toner contained in the toner cartridges, so that the toner may be supplied from the toner cartridge having the least remaining amount.

6 Claims, 7 Drawing Sheets

IMAGE FORMING APPARATUS FOR SUPPLYING TONER FROM ONE OF A PLURALITY OF TONER CARTRIDGES

BACKGROUND OF THE INVENTION

1. Field of the Invention

The present invention relates to an image forming apparatus.

2. Description of the Related Art

An image forming apparatus using the electronic photography is generally constituted to include a photoreceptor which is a rotating image bearing member, and a charging section, an exposure section, a developing section, a transfer section, a fixing section, a cleaning section and a deelectrification section, which are arranged around the photoreceptor. The charging section charges the surface of the photoreceptor uniformly. The exposure section exposes the photoreceptor surface charged, to light according to image information thereby to form an electrostatic latent image. The developing section agitates and charges the toner so that a toner image is formed by adhering the frictionally charged toner to the electrostatic latent image formed on the photoreceptor surface. The transfer section transfers the toner image to a recording medium by charging the recording medium into the polarity reversed from that of the toner. The fixing section fixes the transferred toner image on the recording medium by, for example, heating and pressurizing. The cleaning section recovers the toner which is not transferred to the recording medium but left on the photoreceptor surface. The deelectrification section carries out deelectrification of the photoreceptor in a state where the toner image has been transferred therefrom. By the image forming apparatus using the electrostatic photography thus constituted, a desired image is formed on the recording medium.

This image forming apparatus is equipped with a toner supply section for supplying the toner to a developer container which is a container belonging to the developing section for containing the toner, because the toner used for the development in the developing section is consumed. The toner supply section supplies the developer container with the toner in the toner cartridge which is usually constituted so as to be attachable to and removable from the image forming apparatus. When the toner in the toner cartridge is exhausted as a result of the supply to the developer container, the image forming apparatus interrupts its actions. By replacing the toner cartridge having its toner exhausted by a new toner cartridge, however, the image forming apparatus is supplied with the toner so that it can perform again the image forming actions.

In recent years, there has been developed an image forming apparatus such as a copier or printer of electronic photography, which is intended for heavy users to consume much toner. In this apparatus, as much as toner is contained in one toner cartridge thereby to reduce the number of exchanges of the toner cartridge. When this large-sized toner cartridge containing much toner is used, the number of exchanges can be reduced to interrupt the image forming actions less frequently. It is, therefore, desired to lighten the burden on the user unfamiliar to the handling of the apparatus.

When much toner is contained in one toner cartridge, the number of interruptions of the image forming actions can be reduced by reducing the number of replacements of the toner cartridge. At the time of replacing the toner cartridges, however, it is impossible to avoid the interruption of the image forming actions. As a technique for solving this problem, there has been proposed an image forming apparatus (in Japanese Unexamined Patent Publications JP-A 8-137227 (1996) and JP-A 2003-208007, for example), which is equipped with a plurality of toner cartridges for containing toner of an identical color and which uses the (continuous run) system for automatically replacing the toner cartridge to be supplied with the toner.

The image forming apparatus, as disclosed in JP-A 8-137227, is equipped with a plurality of toner cartridges for storing the toner of an identical color, and toner transfer conduits connected to the plural toner cartridges and merging midway to transfer the toner discharged from the toner cartridge to the inside of the developer container. In the image forming apparatus disclosed in JP-A 8-137227, the toner is supplied from one of the plural toner cartridges. The toner can be supplied, when exhausted in one toner cartridge, from another toner cartridge so that its supply does not interrupt the image forming actions.

In the image forming apparatus disclosed in JP-A 2003-208007, on the other hand, the color image forming apparatus is equipped with a plurality of toner cartridges for a black color to be more consumed than the color toners of yellow, magenta and cyan, and the black toner cartridges are arranged in one row adjacent to each other. According to this image forming apparatus disclosed in JP-A2003-208007, the plural black toner cartridges can prevent the interruptions of the image forming actions from being frequently caused by the exhaustion of the black toner. Since the plural black toner cartridges are arranged in one row adjacent to each other, it is possible to spare the space for the toner containing portion and not to mistake the positions for mounting the toner cartridges.

Here in this image forming apparatus, after the toner cartridge mounted on one toner cartridge mounting portion was used to the last, this mounting portion may be loaded with the toner cartridge before the end of use, which has been employed in another image forming apparatus, or the toner cartridge which has been stored in the unconsumed state. The toner cartridge before the end of use is desirably employed as early as possible, because the toner contained therein is degraded in the charging characteristics and fluidity by the environmental influences such as humidity after left unused for a long time.

In the image forming apparatus disclosed in JP-A8-137227 and in JP-A 2003-208007, the toner cartridges mounted on the two toner cartridge mounting portions are constituted such that they are alternately employed for their individual mounting portions. In case the two mounting portions are provided, which are individually equipped with the toner cartridges, when the toner cartridge of one mounting portion is used up, the toner cartridge of the other mounting portion is employed. While the toner cartridge of the other mounting portion is being employed, the toner cartridge of one mounting portion is replaced by new one. In case this replaced toner cartridge is before the end, this toner cartridge before the end is not employed till the toner of the toner cartridge mounted on the other mounting portion is exhausted.

In the image forming apparatus disclosed in JP-A 8-137227 and JP-A 2003-208007 thus constituted, the toner cartridges mounted in the individual mounting portions are alternately employed for the individual mounting portions, but no consideration is taken into the used situations of the toner. In order to employ the toner cartridge before the end to be earlier employed, therefore, the complicated procedure is required for exchanging the unused toner cartridge to be mounted on the other mounting portion and the toner cartridge before the end of use. During this replacing procedure, moreover, there occurs a time period, for which none of the toner cartridges is mounted, to raise a problem that the image forming actions are interrupted.

SUMMARY OF THE INVENTION

An object of the invention is to provide an image forming apparatus capable of using such a toner cartridge preferentially without interrupting an image forming action as is desired for an early use and as has a less toner remaining amount.

The invention provides an image forming apparatus comprising:

a developing section for developing with toner contained in a developer container;

a plurality of toner cartridges for containing toners of an identical color;

a toner supply section for supplying the toner from the toner-cartridge to the developer container;

a toner remaining amount detecting section for detecting individual remaining amounts of the toners contained in the toner cartridges; and a control section for controlling the toner supply section to select the toner cartridge having the least toner remaining amount detected by the toner remaining amount detecting section, and to supply the toner from the selected toner cartridge to the developer container.

According to the invention, there is provided an image forming apparatus comprising: a plurality of toner cartridges for containing toners of an identical color; a toner supply section for supplying the toner from the toner cartridge to the developer container; a toner remaining amount detecting section for detecting individual remaining amounts of the toners contained in the toner cartridges; and a control section for controlling the toner supply section to select the toner cartridge having the least toner remaining amount detected by the toner remaining amount detecting section, and to supply the toner from the selected toner cartridge to the developer container. In this image forming apparatus, the toner can be preferentially supplied from the toner cartridge of the least toner remaining amount to the developer container. Therefore, when the toner cartridge before the end of use is employed, the toner cartridge before the end of use and to be earlier used can be preferentially employed. This makes it possible to prevent the toner cartridge before the end of use from being degraded in the charging characteristics and fluidity of the toner, as might otherwise be caused after left unused for a long time, so that an image of high quality can always be formed.

In the invention, it is preferable that the toner remaining amount detecting section is disposed in each of the toner cartridges, and the toner remaining amount detecting section includes a nonvolatile memory in which toner remaining amount detection information which is information on the remaining amount of the toner contained in the toner cartridge, is stored.

According to the invention, moreover, the toner remaining amount detecting section is disposed in each of the toner cartridges, and the toner remaining amount detecting section includes the nonvolatile memory in which the toner remaining amount detection information which is the information on the remaining amount of the toner contained in the toner cartridge, is stored. As a result, it is possible to easily grasp the toner remaining amount in the toner cartridge.

Furthermore, in the invention, it is preferable that the toner remaining amount detecting section includes a first wireless transmitting/receiving section for transmitting the toner remaining amount detection information stored in the nonvolatile memory, to an outside, and the control section includes a second wireless transmitting/receiving section for receiving the toner remaining amount detection information transmitted from the first wireless transmitting/receiving section, thereby to control the toner supply section in accordance with the toner remaining amount detection information obtained by the second wireless transmitting/receiving section.

According to the invention, moreover, the toner remaining amount detecting section includes the first wireless transmitting/receiving section disposed in each of the toner cartridges for transmitting the toner remaining amount detection information stored in the nonvolatile memory, to the outside, and the control section includes the second wireless transmitting/receiving section for receiving the toner remaining amount detection information transmitted from the first wireless transmitting/receiving section, thereby to control the toner supply section in accordance with the toner remaining amount detection information obtained by the second wireless transmitting/receiving section. As a result, the toner remaining amount detecting section and the control section can communicate in a non-contact manner so that the arrangement of the toner remaining amount detecting section and the control section can be freely set to spare the space for the apparatus.

Furthermore, in the invention, it is preferable that the toner supply section is a rotational drive section which is disposed in each of the toner cartridges, for rotating the toner cartridge to supply the toner.

According to the invention, moreover, the toner supply section is a rotational drive section which is disposed in each of the toner cartridges, for rotating the toner cartridge to supply the toner. The supply of the toner by the rotation of the toner cartridge is performed, for example, by rotating the toner cartridge of a substantially cylindrical shape about an axis thereof so that the toner may be guided to and fed out from an opening formed in the toner cartridge. This toner supply can make constant the quantity of toner to be fed by the rotation to the opening so that the supply amount of the toner can be stabilized to a predetermined value. Moreover, the toner can be prevented from sticking to the inner wall of the toner cartridge by the rotation of the toner cartridge and accordingly from being left in the toner cartridge. Moreover, it is unnecessary to provide the toner cartridge with a complicated agitating section for preventing the toner from agglomerating in the toner cartridge.

Furthermore, in the invention, it is preferable that the toner cartridge includes a rotation number detecting unit for detecting a number of rotations of the toner cartridge, wherein the accumulated value of the number of rotations of the toner cartridge which number of rotations is detected by the rotation number detecting unit, is stored as the toner remaining amount detection information in the nonvolatile memory.

According to the invention, moreover, the toner cartridge includes the rotation number detecting unit for detecting the number of rotations of the toner cartridge, wherein the accumulated value of the number of rotations of the toner cartridge which number of rotations is detected by the rotation number detecting unit, is stored as the toner remaining amount detection information in the nonvolatile memory. As a result, the weight of the toner contained in the toner cartridge can be easily detected without providing a weight sensor for detecting the toner weight in the toner cartridge.

Furthermore, in the invention, it is preferable that the toner cartridge includes a rotation number detecting unit for detecting a number of rotations of the toner cartridge, and a remaining amount calculating section for calculating the remaining amount of the toner reserved in the toner cartridge, from the accumulated value of the number of rotations of the toner cartridge which number of rotations is detected by the rotation number detecting unit, wherein the toner remaining amount calculated by the remaining amount calculating section is stored as the toner remaining amount detection information in the nonvolatile memory.

According to the invention, moreover, the toner cartridge includes the rotation number detecting unit for detecting the number of rotations of the toner cartridge, and the remaining amount calculating section for calculating the remaining amount of the toner reserved in the toner cartridge, from the accumulated value of the number of rotations of the toner cartridge which number of rotations is detected by the rotation number detecting unit, wherein the toner remaining amount calculated by the remaining amount calculating section is stored as the toner remaining amount detection information in the nonvolatile memory. As a result, the weight of the toner in the toner cartridge can be easily detected without any weight sensor.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
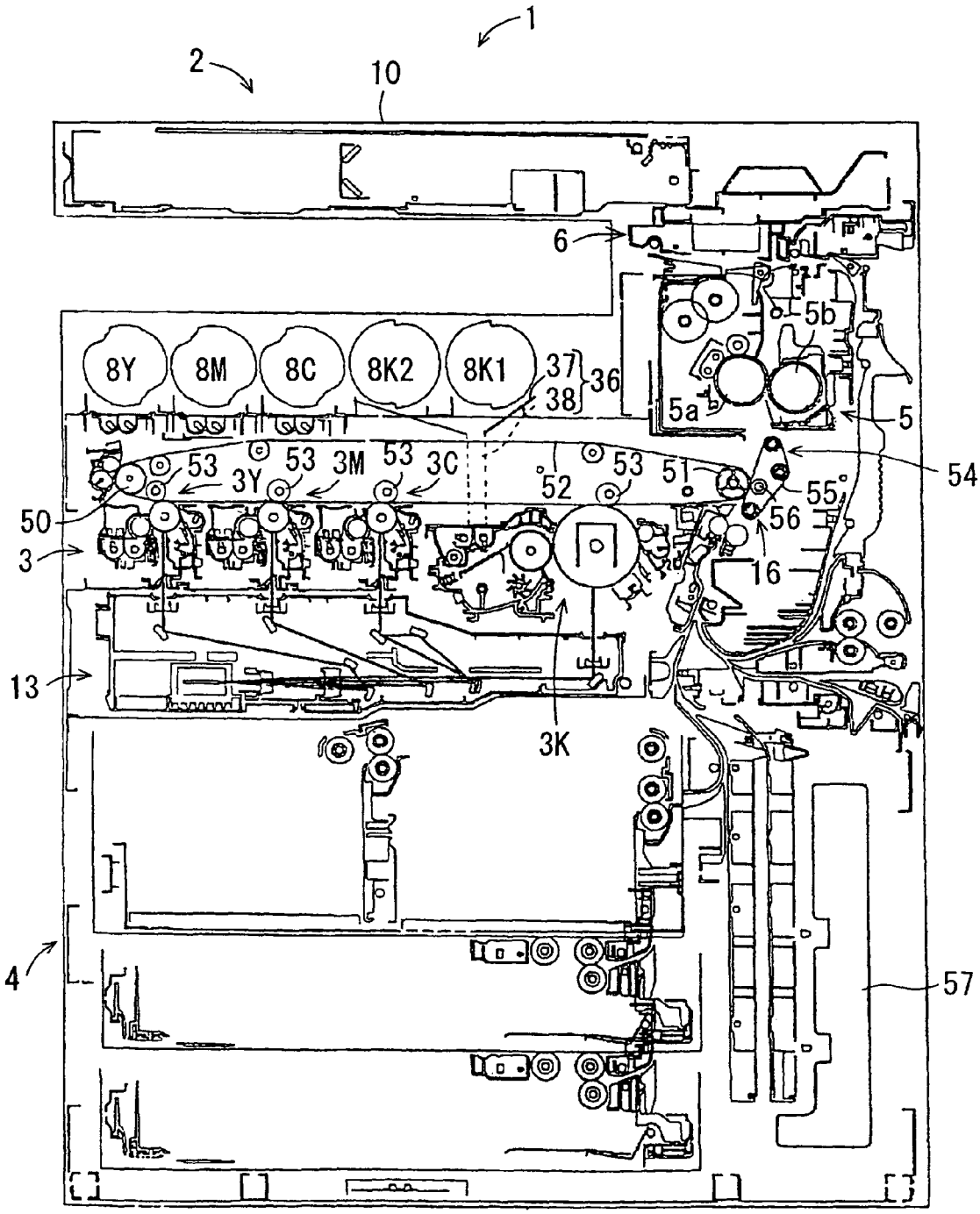
FIG. 1 is a diagram showing a constitution of an image forming apparatus according to one embodiment of the invention.

Now referring to the drawings, preferred embodiments of the invention are described below.

Figure 2:
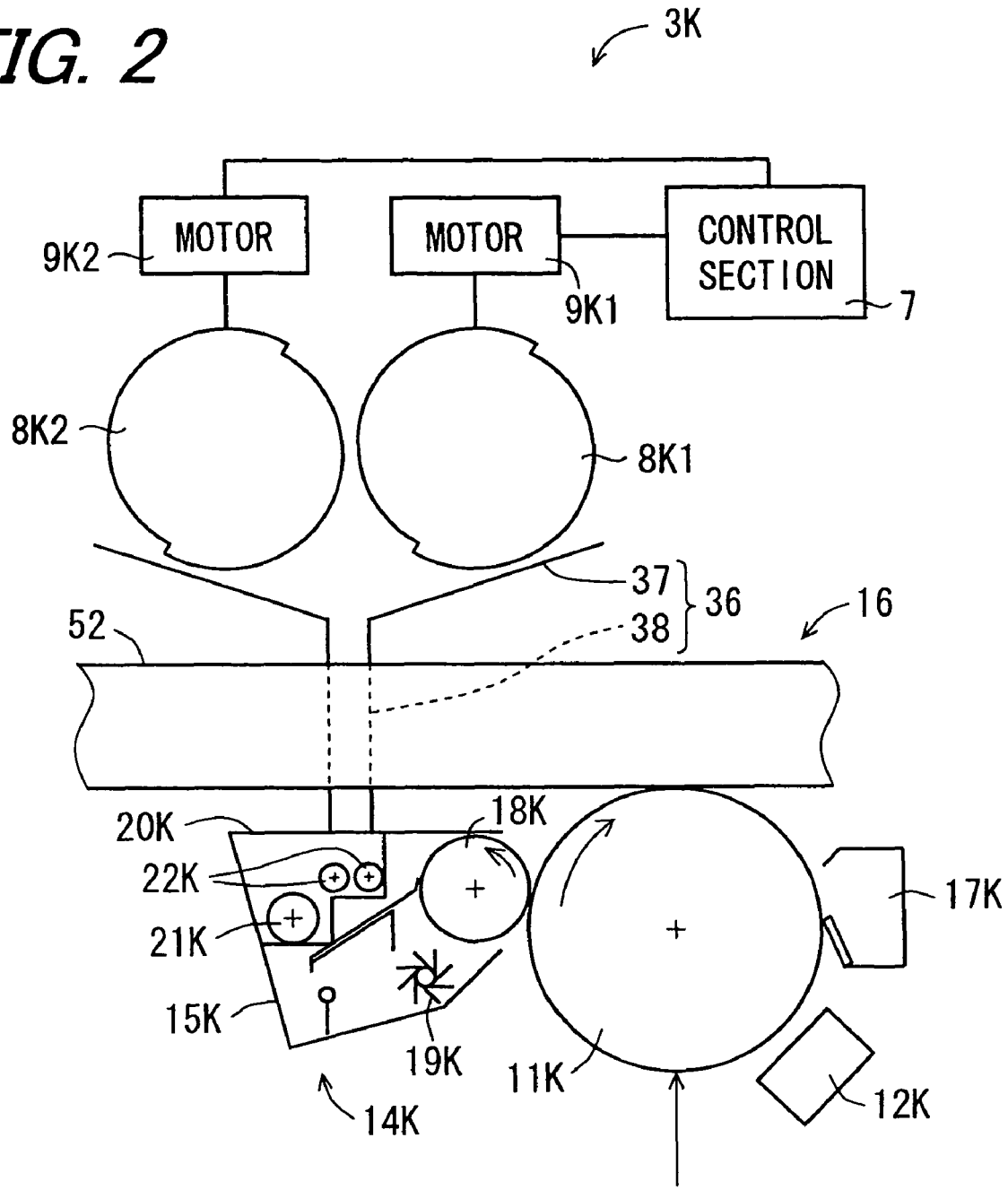
FIG. 2 is an enlarged diagram schematically showing a constitution around a developing section, as belonging to the image forming apparatus shown in FIG. 1, of a black image.

FIG. 1 is a diagram showing a constitution of an image forming apparatus 1 according to one embodiment of the invention, and FIG. 2 is an enlarged diagram schematically showing a constitution around a developing section 14K, as belonging to the image forming apparatus 1 shown in FIG. 1, of a black image. The image forming apparatus 1 is a full-color image forming apparatus using the electronic photography, as exemplified a multifunctional system having the functions of a copier, a printer and the like.

The image forming apparatus 1 is constituted to include an image information reading unit 2, an image processing unit (not shown), an image forming unit 3, a paper feeding unit 4, a fixing unit 5, a paper discharge unit 6 and a control section 7. The image information reading unit 2 reads image information of a document. The image processing unit image processes either the image information read by the image information reading unit 2 or image information inputted from an external device such as a personal computer. The image forming unit 3 forms an image on the basis of image information outputted from the image processing unit. The paper feeding unit 4 feeds the sheet of recording paper to the image forming unit 3. The fixing unit 5 fixes the image which has been formed in the image forming unit 3 and transferred to the sheet of recording paper. The paper discharge unit 6, to which the sheet of recording paper having the fixed image is discharged. The control section 7 controls the actions of the whole image forming apparatus 1.

The image forming apparatus 1 is characterized in that, when the toner of an identical color (e.g., black in this embodiment) is to be supplied to a developer container 15K from a plurality of (e.g., two in this embodiment) toner cartridges 8K1 and 8K2 containing that toner, the control section 7 controls the actions of motors 9K1 and 9K2 as a toner supply section for supplying the toner from the toner cartridges 8K1 and 8K2 to the developer container 15K, to select a toner cartridge 8 having the least toner content detected by the later-described wireless IC tag as the toner remaining amount detecting section for detecting the remaining amounts of toners contained in the toner cartridges 8K1 and 8K2, individually, and to supply the toner from the toner cartridge 8 to the developer container 15K.

The image information reading unit 2 reads out the image information of the document placed on a document platen 10. The image information reading unit 2 is constituted to include the not-shown document scanning unit adapted to be reciprocally moved in parallel with the lower face of the document platen 10, an optical lens, and a CCD (charge coupled device) line sensor which is a photoelectric conversion element. The image information reading unit 2 reads out a monochrome image or color image of the document placed on the document platen 10, and outputs the image information of that image to the image processing unit (not shown). This image processing unit converts the image information, as inputted from the external device such as the image information reading unit 2 or the personal computer, into electric signals of individual colors, and outputs the electric signals individually to an exposure unit 13 of the image forming unit 3.

The image forming unit 3 is constituted to include a photoreceptor 11 for having an electrostatic latent image formed on its surface, a charger 12, the exposure unit 13, a developing section 14, a transfer unit 16 and a cleaning section 17. The charger 12, the exposure unit 13, the developing section 14, the transfer unit 16 and a cleaning section 17 are disposed around the photoreceptor 11. The charger 12 charges the photoreceptor 11 uniformly. The exposure unit 13 exposes the surface of the charged photoreceptor 11 to light according to the image information outputted from the image processing unit, and forms the electrostatic latent image. The developing section 14 forms a toner image on the surface of the photoreceptor 11 with the toner contained in a developer container 15. The transfer unit 16 transfers the toner image formed on the surface of the photoreceptor 11 by the developing section 14 to the sheet of recording paper. The cleaning section 17 cleans the surface of the photoreceptor 11 after the toner image has been transferred by the transfer unit 16.

Here, the image forming unit 3 is formed integrally with the exposure unit 13 but is equipped with the individual units for forming a black image, a cyan image, a magenta image and a yellow image. In FIG. 1, therefore, the image forming unit 3 is indicated by attaching alphabets K (black), C (cyan), M (magenta) and Y (yellow) to the tail thereof. In FIG. 2, on the other hand, the individual units of the image forming unit 3K for forming the black image are expressed by attaching the alphabet K indicating the black to the tails of the aforementioned reference numerals.

As to the image forming unit 3, the image forming unit 3K for the black image is described as a representative with reference to FIG. 2. The image forming units 3 for the remaining colors are constituted identically to the image forming unit 3K for the black color except that one toner cartridge is provided and that the individual units of the toner cartridge 8 and the image forming unit 3 have different sizes, so that their descriptions are omitted.

Here, the individual units of the black image forming unit 3K are made larger than the individual units of the remaining color image forming units 3. This is because it is anticipated that the number of times for forming the black color is larger than those for forming the images of the other colors. In case the black image forming unit 3K is formed to have the same size as those of the other color image forming units 3, the number of forming the black image becomes larger than the number of forming the image of the other colors, thereby the number of rotations of the photoreceptor 11K becomes larger than those for the other colors so that the lifetime of the photoreceptor 11K becomes shorter than those of the photoreceptors 11 for the other colors.

Therefore, the photoreceptor 11K is made larger than the other color photoreceptors 11 so that no substantial difference may not arise from the lifetimes of the other color photoreceptors 11. The developing section 14K for the black image forming unit 3K is made so larger than the other color developing section 14K as to match the size of the black image forming photoreceptor 11 larger than the other color photoreceptors 11. Here, the image forming apparatus 1 of the invention should not be limited to the constitution, in which the individual units of the black image forming unit 3 are larger than those of the other color image forming units 3, but may also be constituted such that all the individual units of the black, cyan, magenta and yellow image forming units 3 are made to have an equal size.

The exposure unit 13 is constituted of an optical unit (LSU: Laser Scanning Unit) including a semiconductor laser element for emitting a laser beam which is a dot beam which is modulated according to pixel signals inputted from the image processing unit, and a mirror for guiding the beam emitted from the semiconductor laser element, into the photoreceptors 11 for the individual colors.

The developing section 14K develops the electrostatic latent image formed by the exposure unit 13 on the surface of the photoreceptor 11, thereby to visualize the latent image by forming a toner image. The developing section 14K includes a developing roller 18K, an agitating roller 19K, a developer container 15K, a toner hopper 20K, a toner supply roller 21K, a toner feeding roller 22K, the toner cartridges 8K1 and 8K2. The developing roller 18K is disposed to face the photoreceptor 11K and feeds the toner to the electrostatic latent image on the surface of the photoreceptor 11K. The agitating roller 19K agitates and transports the developer to the developing roller 18K. The developer container 15K houses the developing roller 18K and the agitating roller 19K. The developing roller 18K and the agitating roller 19K are rotatably mounted in the developer container 15K. The toner hopper 20K is a container formed to communicate with the developer container 15K through a hopper supply port (not shown) and for supplying the developer container 15K with the toner. The toner supply roller 21K is disposed just above the hopper supply port for feeding the toner from the toner hopper 20K to the developer container 15K. The toner feeding roller 22K feeds the toner to the toner supply roller 21K. The toner cartridges 8K1 and 8K2 supply the developer toner to the developer container 15K through the toner hopper 20K.

The developer container 15K is a container made of a hard synthetic resin, for example, for containing the toner, and is formed integrally with the toner hopper 20K. In or near the developer container 15K, a toner density sensor (not shown) is disposed for detecting the toner density in the developer container 15K. The detection result of the toner density by the toner density sensor is outputted to the control section 7.

The toner to be supplied to the developer container 15K is contained in the toner cartridge 8 which is removably mounted in the image forming apparatus 1. This image forming apparatus 1 of this embodiment is equipped, as its toner cartridge 8, with two black toner cartridges (as will be conveniently called the first toner cartridge 8K1 and the second toner cartridge 8K2), and each one of the cyan color toner cartridge 8C, the magenta color toner cartridge 8M and the yellow toner cartridge 8Y. Each toner cartridge 8 has a substantially cylindrical shape and is connected with a motor 9 acting as a rotational drive section for rotating the toner cartridge 8 about its rotation axis. The motor 9 rotates the toner cartridge 8 thereby to supply the toner.

Here, the individual toner cartridges for the black, cyan, magenta and yellow colors are formed to have substantially identical shapes. Since it is expected that the consumption rate of the black toner is more than those of the other colors, the black toner cartridges 8K1 and 8K2 are made diametrically larger than those of the individual cartridges for the cyan, magenta and yellow colors. However, all the cartridges may also have identical sizes.

Moreover, the image forming apparatus 1 of this embodiment is exemplified by an intermediate speed machine (having an image forming ability of about 30 sheets per minute), and the number of the black toner cartridges 8K1 and 8K2 is two. It is, however, preferable that the number of black toner cartridges is increased, for example, three, as the image forming ability becomes high.

Figure 3B:
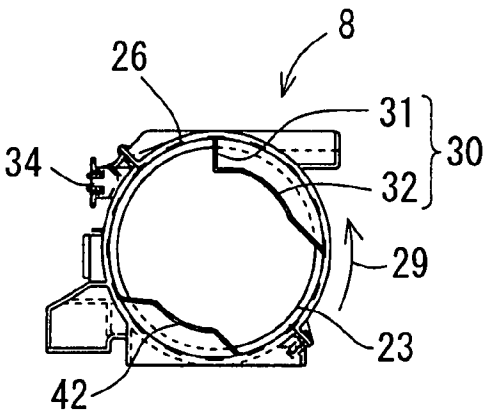
FIGS. 3A and 3B are diagrams showing a constitution of a toner cartridge in a simplified form.
Figure 3A:
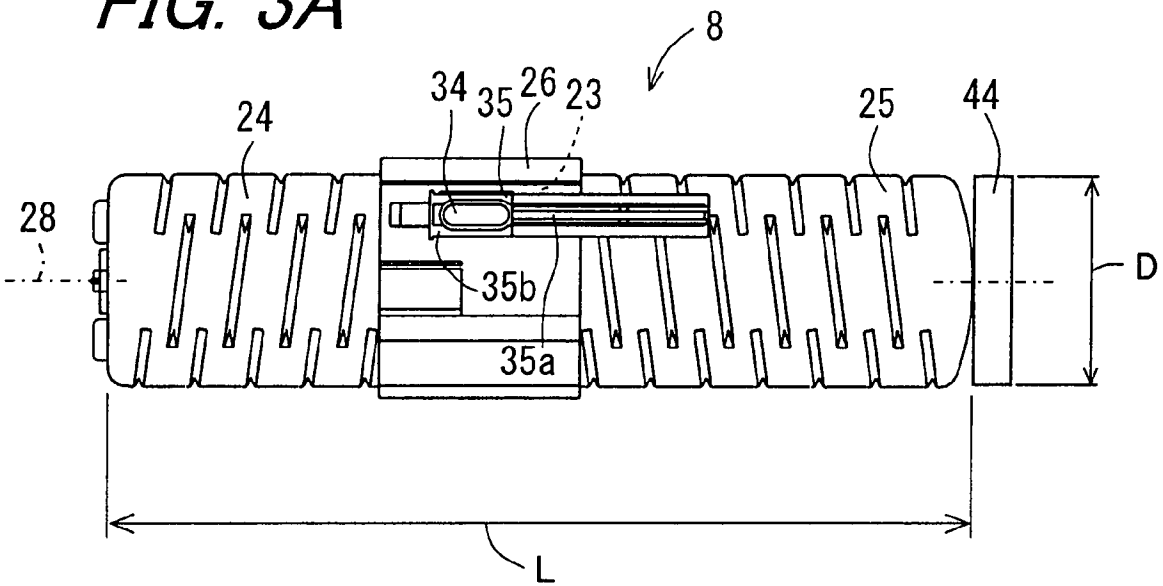
Figure 4:
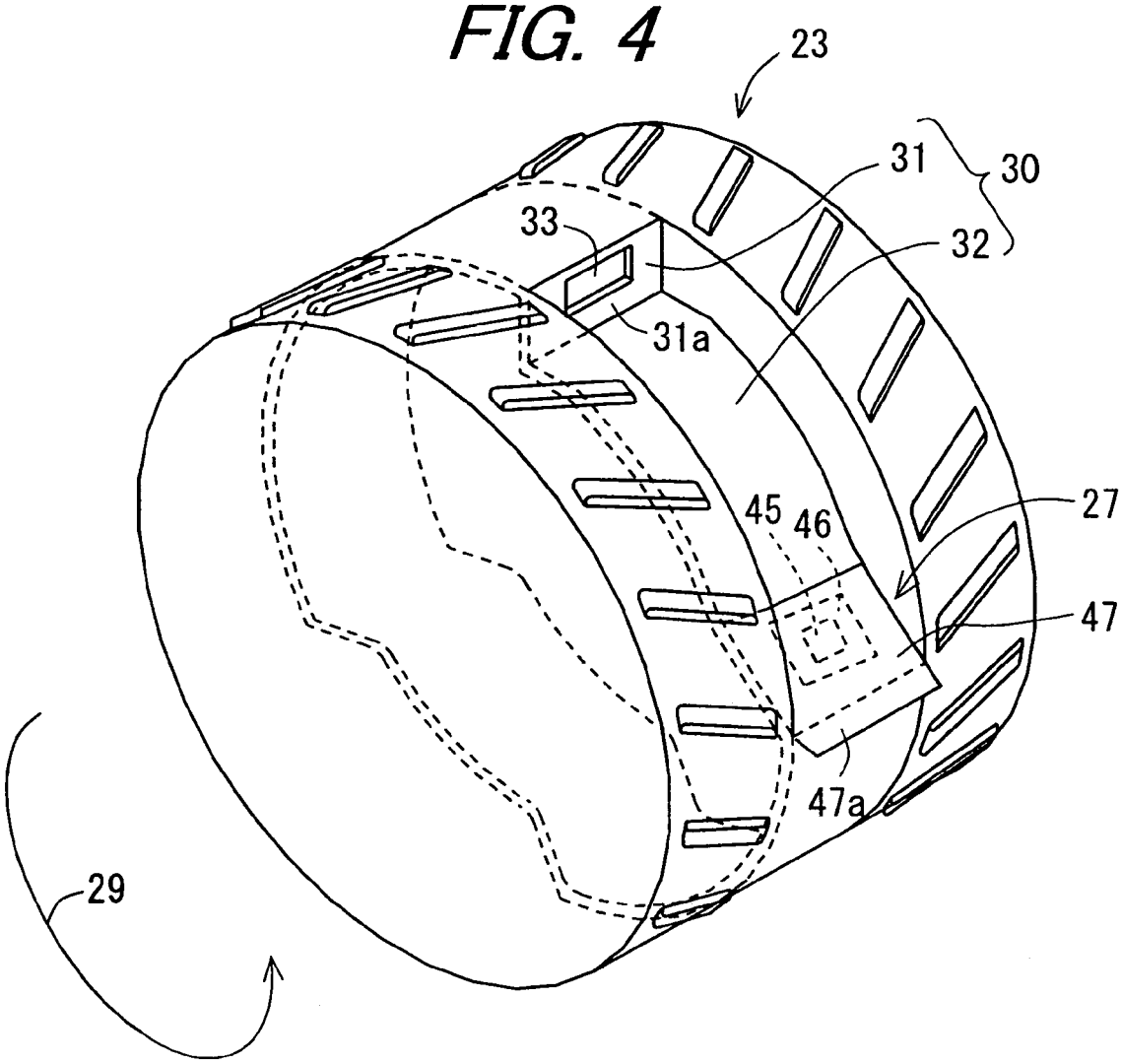
FIG. 4 is a perspective view showing a central container portion belonging to the toner cartridge shown in FIG. 3A and FIG. 3B.

FIGS. 3A and 3B are diagrams showing the constitution of the toner cartridge 8 in a simplified form, and FIG. 4 is a perspective view showing a central container portion 23 belonging to the toner cartridge 8 shown in FIGS. 3A and 3B. The toner cartridge 8 is formed of a hard synthetic resin, for example, into such a bottomed generally cylindrical shape that the corner portion in a cross section normal to the rotation axis 28 is curved to have no corner. The outer diameter of the toner cartridge is exemplified such that the black toner cartridge has a diameter D of 110 mm, a length L of 450 mm and a toner containing capacity of about 4,000 $cm^3$. The toner cartridges for the individual cyan, magenta and yellow colors have a diameter D of 78 mm, a length L of 450 mm and a toner containing capacity of about 2,000 $cm^3$.

The toner cartridge 8 is substantially constituted to include: the central container portion 23 disposed substantially at the central portion in a longitudinal direction; first and second container portions 24 and 25 disposed to extend from the central container portion 23 toward opposite sides of the longitudinal direction; and a support member 26 disposed to cover an outer circumference of the central container portion 23. Moreover, each toner cartridge 8 is equipped, at its central container portion 23, with a wireless IC tag 27 acting as a toner remaining amount detecting section for detecting the remaining amount of the toner contained in the toner cartridge 8. This toner cartridge 8 is rotationally driven about the rotation axis 28 in the direction of an arrow 29 by the motor 9 acting as the rotational drive section.

The first and second container portions 24 and 25 of the toner cartridge 8 are containers of a bottomed cylindrical shape both having an opening on one end, and are so individually mounted on the central container portion 23 that the internal spaces of the first and second container portions 24 and 25 and the internal space of the central container portion 23 may communicate through the openings. The central container portion 23 is formed into a substantially cylindrical shape, and has a recess 30 having a slope in the substantially central portion in the longitudinal direction over about one quarter of the outer circumference thereof.

The recess 30 is formed to include a step portion 31 recessed in a radial direction of the central container portion 23, and a slope portion 32 formed to become shallower from the downstream side to the upstream side in the rotational direction 29 of the toner cartridge 8. In a falling portion 31*a* inward of the radial direction of the step portion 31, there is formed an opening 33, which communicates with the internal space of the central container portion 23. According to the rotating action of the toner cartridge 8 in the direction of the arrow 29, the toner contained in the toner cartridge 8 is discharged from that opening 33, which will be called the toner discharge port 33.

The support member 26 disposed to cover the central container portion 23 is a member for rotatably supporting the central container portion 23 and the first and second container portions 24 and 25 of the toner cartridge 8 rotated by the motor 9. The support member 26 is equipped, at its position corresponding in the longitudinal direction to the recess 30 formed in the central container portion 23, with a leading through hole 34 leading to the outer circumference of the central container portion 23, and a shutter member 35 for opening/closing the leading through hole 34 temporarily. The shutter member 35 is constituted to include a guide member 35*a*, a cover member 35*b* and a drive mechanism (not shown). The guide member 35*a* is disposed in the longitudinal direction of the toner cartridge 8. The cover member 35*b* makes slidable in the longitudinal direction of the toner cartridge 8 while being guided by the guide member 35*a*, thereby to open/close the leading through hole 34. The not-shown drive mechanism slides the cover member 35*b*.

The leading through hole 34 of the support member 26 is constituted to communicate with the developer container 15 of the developing section 14 through a leading member 36 and the toner hopper 20. As a result, when the container portion of the toner cartridge 8 rotates in the direction of the arrow 29, the toner contained in the toner cartridge 8 is discharged in a predetermined quantity from the toner discharge port 33, and the toner discharged is transferred by the slope portion 32 to the outer circumference of the central container portion 23 so that the toner transferred is supplied to the developer container 15 through the leading through hole 34 in the open state and through the leading member 36. FIG. 1 shows only the leading member 36 for feeding the toner contained in the black toner cartridges 8K1 and 8K2, but omits the leading members for feeding the cyan, magenta and yellow toners.

The leading member 36 is constituted to include a toner receiving portion 37 formed in a funnel shape, and a conduit portion 38. The toner discharged in the predetermined quantity from the toner discharge port 33 through the leading through hole 34 is discharged to the toner receiving portion 37 and fed to the conduit portion 38 so that the toner is supplied to the developer container 15 through the toner hopper 20 from the conduit portion 38.

FIGS. 5A to 5D are sectional views showing an outline of the action to supply the toner to the developing section 14 of the toner cartridge 8. The actions of the toner cartridge at the time when the toner of the predetermined quantity is fed from the toner cartridge 8 to the developer container 15 will be further described with reference to FIGS. 5A to 5D.

Figure 5A:
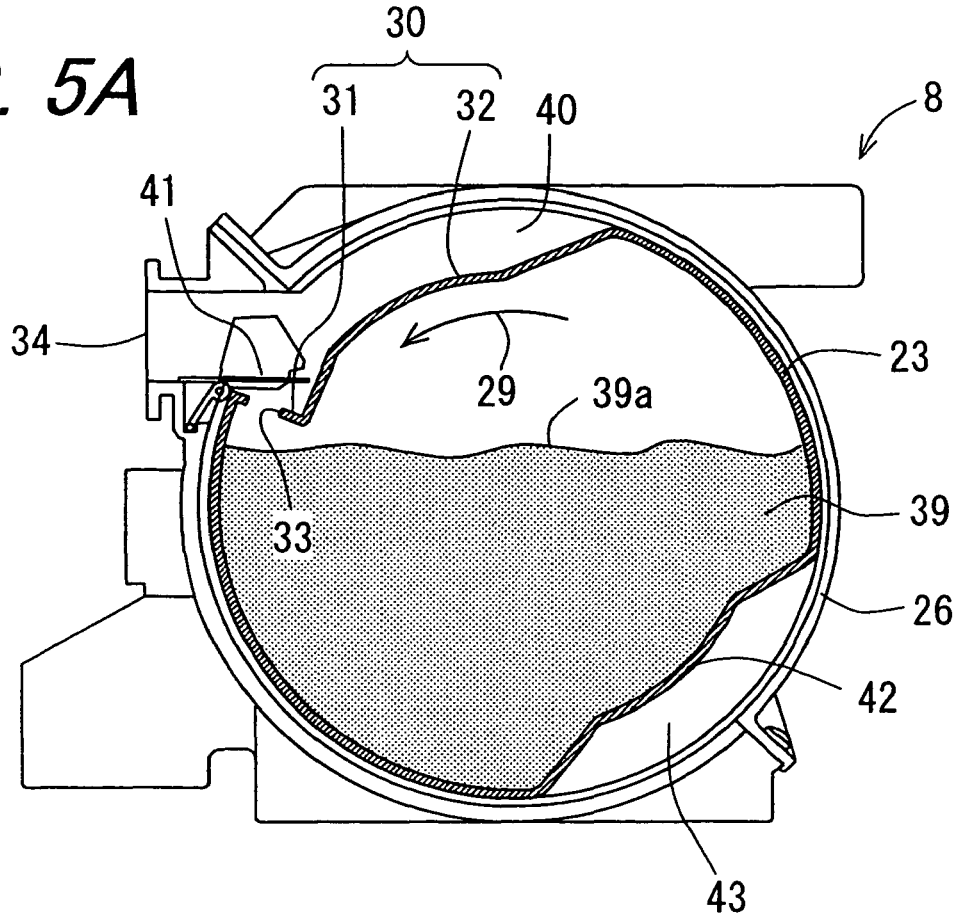
FIGS. 5A to 5D are sectional views showing an outline of an action to supply toner to the developing section of the toner cartridge.
Figure 5B:
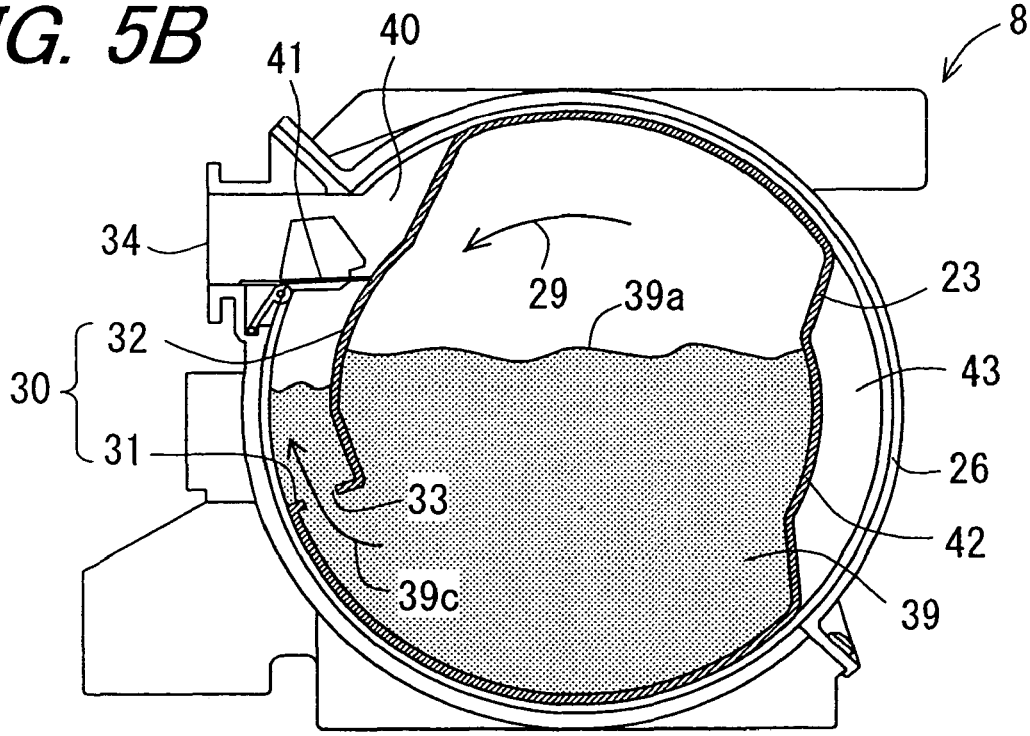

In FIG. 5A, the rotational position of the toner cartridge 8 is located such that the recess 30 and the toner discharge port 33 formed in the central container portion 23 are positioned above the upper face 39*a* (as will be called the toner layer face 39*a*) of the toner 39 contained in the central container portion 23. When the central container portion 23 of the toner cartridge 8 rotates about the rotation axis 28 in the direction of the arrow 29 so that the toner discharge port 33 comes to a position below the toner layer face 39*a*, the toner 39 in the central container portion 23 flows into the recess 30 through the toner discharge port 33, as indicated by arrow 39*c*.

Figure 5C:
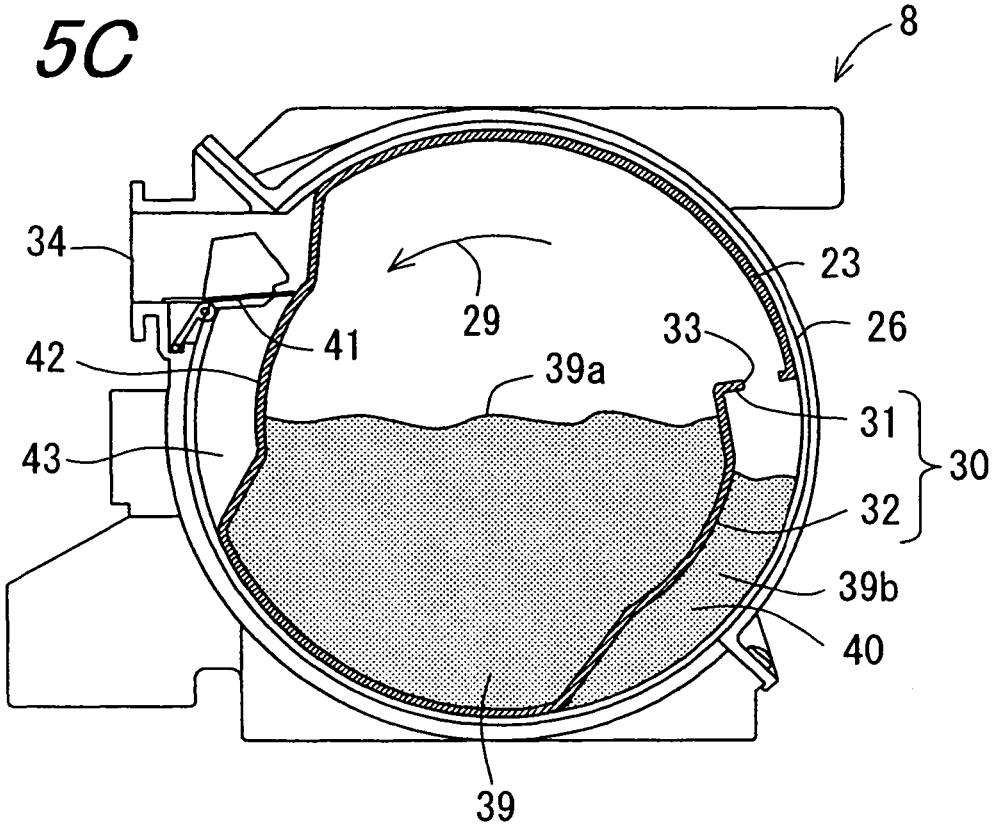
Figure 5D:
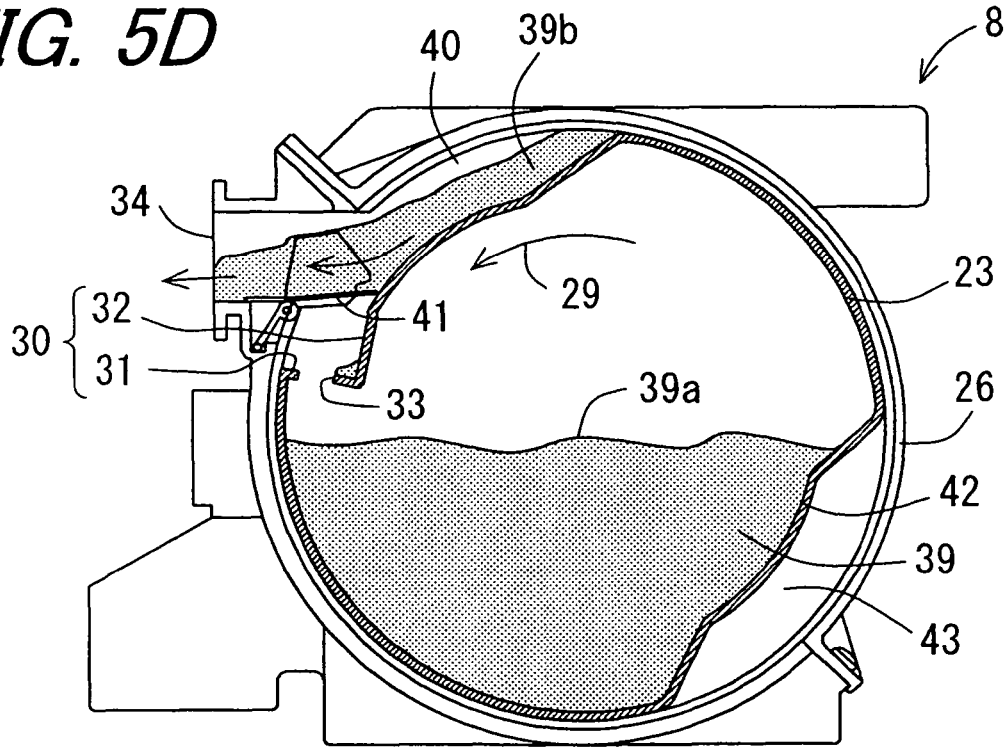

When the toner cartridge 8 further rotates in the direction of the arrow 29, the toner discharge port 33 is positioned above the toner layer face 39*a*, as shown in FIG. 5C, the flow the toner 39 into the recess 30 through the toner discharge port 33 is stopped, so that the toner 39*b* of a predetermined quantity is held in a space 40 which is defined by the recess 30 of the central container portion 23 and by the inner wall of the support member 26. The quantity of the toner 39*b*, which is thus held in the space 40 formed by the recess 30 and the inner wall of the support member 26, is 6 grams, for example.

When the toner cartridge 8 further rotates in the direction of the arrow 29 from the state shown in FIG. 5C, the toner 29*b*, which is held in the space 40 formed by the recess 30 and the inner wall of the support member 26, is guided into the toner discharge port 33 while being guided by a guide member 41 which can slide in elastic abutment against the outer circumference of the central container portion 23. At this time, the guide member 41 slides in abutment against the outer circumference of the central container portion 23 so that the guide member 41 can guide the toner 39 held in the recess 30, as wholly as possible into the toner discharge port 33. The toner 39*b* thus guided into the toner discharge port 33 is fed via the leading member 36 and through the toner hopper 20 into the developer container 15 of the developing section 14. Thus, the toner 39 contained in the toner cartridge 8 is fed in the predetermined quantity to the developer container 15 as the toner cartridge 8 makes one rotation.

In the central container portion 23, there is also formed another recess 42, which is located at a position substantially symmetric to the aforementioned recess 30 with respect to the rotation axis 28. As a result, another space 43 is formed between the other recess 42 and the inner wall of the support member 26. This other space 43 is provided for holding the developer, in case the toner 39*b* held in the space 40 leaks from a side of the space 40 upstream in the rotation direction indicated by the arrow 29. Like the toner 39*b* held in the space 40, the developer held in that other space 43 is guided, as the central container portion 23 rotates in the direction of the arrow 29, into the toner discharge port 33 by the guide member 41 which slides in abutment against the outer circumference of the central container portion 23. Thus, the toner 39*b*, if having leaked from the space 40, is held by the other space 43 and is guided by the guide member 41 into the toner discharge port 33 so that the toner of the predetermined quantity can be reliably fed to the developing section 14.

When the toner cartridge 8 is formed such that the corner portion in the section normal to the rotation axis 28 is curved to have no corner, as described herein before, its internal space is also formed to have no corner. As a result, the discharge of the toner accompanying the rotation is smoothed to leave little toner in the internal space, but the toner remaining amount is used up to the lower limit so that the toner cartridge removed from the apparatus body can be easily cleaned in its inside and eliminated for easy reuse in a substantially complete state without any toner being left.

On one end portion of the toner cartridge 8, i.e., at the bottom portion of the second container portion 25, moreover, there is mounted a rotation number detecting unit 44 for counting the number of rotations of the container portion of the toner cartridge 8. The rotation number detecting unit 44 used is equipped with a known rotating meter of the type for outputting a signal for one rotation, and a transmission unit for transmitting a signal output to the wireless IC tag 27 which is the toner remaining amount detecting section for detecting the remaining amount of the toner contained in the toner cartridge 8. This rotation number detecting unit 44 will be simply called the rotating meter 44.

The wireless IC tag 27 is disposed in each of the toner cartridges 8. The wireless IC tag 27 is constituted to include: an IC chip unit 45 which is a nonvolatile memory for storing the toner remaining amount detection information on the remaining amount of the toner contained in the toner cartridge 8; an antenna unit 46 as a first wireless transmitting/receiving section for transmitting the toner remaining amount detection information stored in the IC chip unit 45, to the outside; and a base film 47 having the IC chip unit 45 and the antenna unit 46 mounted thereon. The wireless IC tag 27 as the toner remaining amount detecting section is disposed in the central container portion 23.

The base film 47 is a film made of polyester, for example. The base film 47 is mounted such that its one end portion slightly protrudes from the slope portion 32 onto the outer circumference of the central container portion 23. This base film protrusion 47*a* from the slope portion 32 functions as a scraper for feeding the toner, as discharged from the toner discharge port 33 and transferred along the slope portion 32 to the vicinity of the outer circumference of the central container portion 23, smoothly into the leading through hole 34.

The antenna unit 46 is a communication unit for transferring and receiving the information with the rotating meter 44 and for transmitting the toner remaining amount detection information to be stored in the IC chip unit 45, to a later-described communication device which is a second wireless transmitting/receiving section contained in the control section 7.

The IC chip unit 45 is a storage unit forming a major portion of the wireless IC tag 27. This IC chip unit 45 can store identification information for identifying the kind of the toner cartridge 8, and the toner remaining amount detection information on the remaining amount of the toner by the rotating meter 44. Here, the identification information for identifying the kind of the toner cartridge 8 indicates what of the black toner, the cyan toner, the magenta toner and the yellow toner the toner contained in the toner cartridge 8 is. This identification information is inputted to the IC chip unit 45 by the dedicated input device when the toner cartridge is manufactured and charged with the toner of each color.

The toner remaining amount detection information is stored as an accumulated value of the number of rotations detected by the rotating meter 44. The toner of the predetermined quantity is discharged for each rotation of the container portion of the toner cartridge 8, as described herein before, so that the information on the total of the toner discharged can be acquired in terms of the accumulated value of the number of rotations. The detection information of the number of rotations by the rotating meter 44 is rewritten and inputted in real time, as the image forming apparatus 1 moves, into the IC chip unit 45 through the antenna unit 46 of the wireless IC tag 27. Here, the wireless IC tag 27 may store, in addition to the aforementioned information, other pieces of information such as the sheet number of the image-formed sheet of recording paper, the process condition or the developing condition.

The control section 7 controls the actions of the motor 9 as the toner supply section for supplying the toner from the toner cartridge 8 to the developer container 15, i.e., the rotational drive section for supplying the toner, when it rotates the toner cartridge 8. The control section 7 rotates the motor 9 to supply the toner from the toner cartridge 8, when the toner density, as outputted from the toner density sensor disposed in or near the developer container 15, in the developer container 15 becomes lower than a predetermined density. Here, this predetermined density is properly determined to a value higher than the lower limit of the toner density for a satisfactory image density.

When the toner density in the black image developer container 15K, as supplied with the toner from one of the two toner cartridges 8K1 and 8K2, becomes lower than the predetermined density, the control section 7 controls the actions of the motor 9K1 or 9K2 as the toner supply section to select the toner cartridge 8, the remaining amount of which is detected at the least by the wireless IC tag 27 which is the toner remaining amount detection section, and to supply the toner from that toner cartridge 8 to the developer container 15K. The control section 7 acquires the remaining amount of the toner in each toner cartridge 8 by the following electric configuration.

Figure 6:
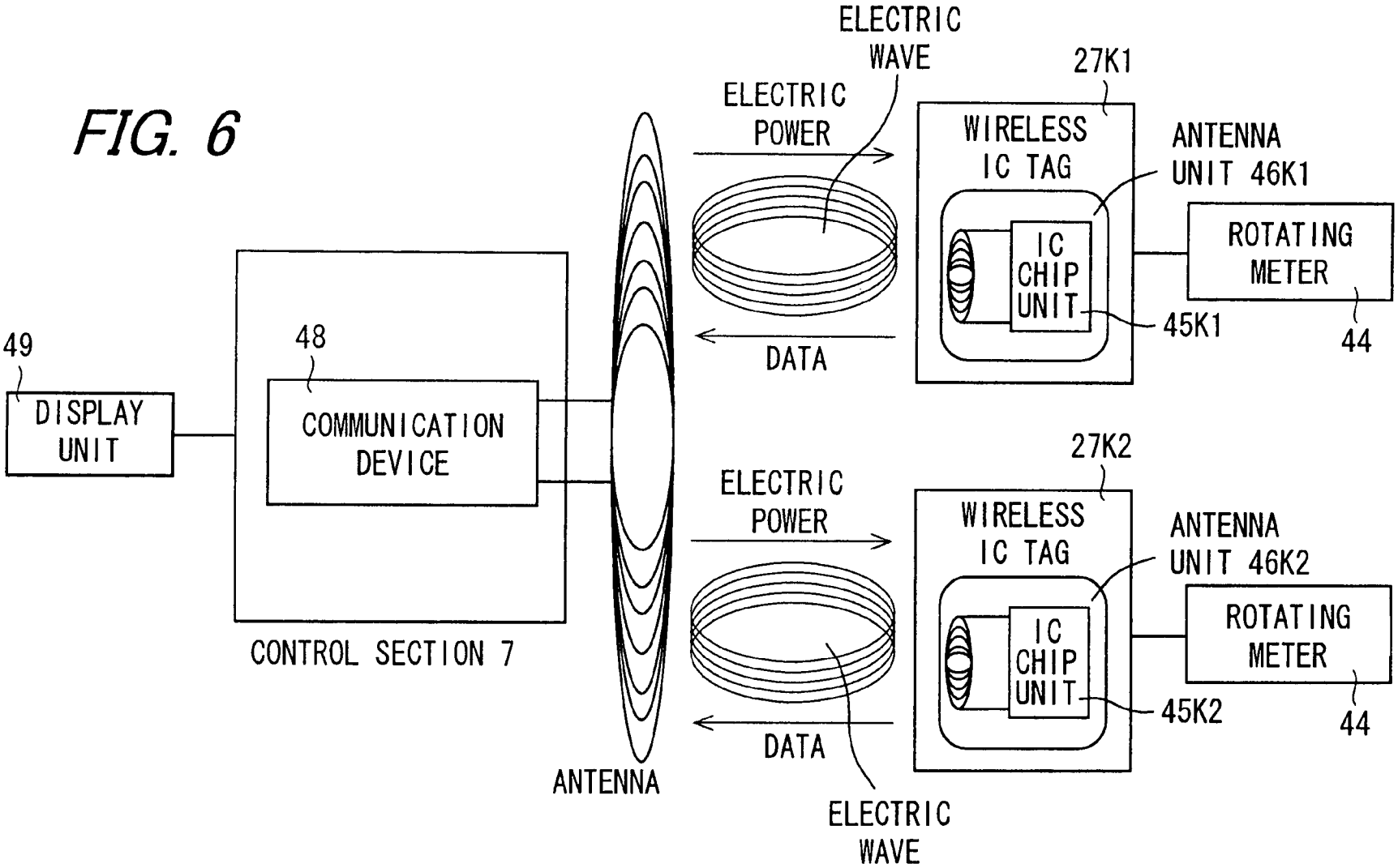
FIG. 6 is a block diagram showing an electric configuration relating to the actions, as based on information stored in a wireless IC tag, of a control section.

FIG. 6 is a block diagram showing an electric configuration relating to the actions, as based on the information stored in the wireless IC tag 27, of the control section 7. This control section 7 is equipped with a communication device 48 as the second wireless transmitting/receiving section for receiving the toner remaining amount detection information transmitted from the wireless IC tag 27.

The detected output of the number of rotations of the rotating meter 44 is fed, as has been described herein before, from the communication unit of the rotating meter 44 through the antenna unit 46 of the wireless IC tag 27 to the IC chip unit 45 so that it is stored as the accumulated value of the number of rotations.

When it is detected by the toner density detecting sensor that the toner density in the developer container 15 of a color is lower than a predetermined toner value, the communication device 48 transmits such a signal to the antenna unit 46 of the wireless IC tag 27 belonging to the toner cartridge 8 for the corresponding color as to request that the toner remaining amount detection information on the toner remaining amount is transmitted to the communication device 48. In response to this signal, the antenna unit 46 of the wireless IC tag 27 belonging to the toner cartridge 8 for the corresponding color transmits the accumulated value, as read out as the toner remaining amount detection information on the remaining amount of the toner, of the number of rotations to the communication device 48 of the communication section 7.

The control section 7 is equipped with a storage unit (not shown), which is prestored with both the initial value of the quantity of the toner to be contained at the time of manufacturing the toner cartridge 8 and the quantity of toner to be discharged for one rotation of the toner cartridge 8. With the value prestored in the storage unit and with the accumulated value of the number of rotations received by the communication device 48, the calculation expressed by Equation (1) is executed to acquire the remaining amount of the toner to be contained in the toner cartridge 8:

$$\text{Toner Remaining Amount} = (\text{Initial Toner Quantity} - \text{Toner discharge for One Rotation} \times \text{Accumulated Number of Rotations}) \quad (1).$$

In the control section 7, when the toner remaining amount obtained by Equation (1) is the lower limit predetermined and stored in the storage unit or less (i.e., empty less than the lower limit of the available quantity), it is indicated, for example, in a display unit 49 of the image forming apparatus 1 that the toner cartridge for that color is at the timing for replacement. In view of these display contents, the operator of the image forming apparatus 1 executes the replacement of the toner cartridge.

The control section 7 thus acquiring the toner remaining amount detection information controls the motors 9K1 and 9K2 in the following manners, when the toner density in the developer container 15K for the black image becomes lower than the predetermined value. At first, the control section 7 causes the communication device 48 to transmit the signal requesting the transmission of the toner remaining amount detection information, to the antenna units 46K1 and 46K2 of the wireless IC tags 27K1 and 27K2 belonging to the first black toner cartridges 8K1 and 8K2, respectively. In response to this signal, the antenna units 46K1 and 46K2 transmit the individual pieces of toner remaining amount detection information of the individual toner cartridges 8 to the communication device 48.

In response to the toner remaining amount detection information transmitted to the communication device 48, the control section 7 drives either the motor 9K1 or the motor 9K2 to supply the toner from the toner cartridge 8 having the less toner remaining amount, so that the toner may be supplied from the toner cartridge 8 having the less toner remaining amount. Thus, the toner cartridge 8 detected to have the least toner remaining amount by the wireless IC tag 27 is selected, and the motor 9 is controlled to supply the toner from the toner cartridge 8 to the developer container 15K.

Reverting to FIG. 1, the transfer unit 16 is described. This transfer unit 16 is constituted to include a drive roller 50, a driven roller 51, an intermediate transfer belt 52 of an endless shape, four intermediate transfer rollers 53 and a secondary transfer section 54. The intermediate transfer belt 52 of an endless shape extends under tension between the drive roller 50 and the driven roller 51. The four intermediate transfer rollers 53 are disposed to face the four photoreceptors 11 through the intermediate transfer belt 52. The secondary transfer section 54 is disposed to face the drive roller 51. The secondary transfer section 54 is constituted to include an endless transfer belt 55 extended between a transfer belt drive roller and two transfer belt driven rollers, and a secondary transfer roller 56 disposed to face the driven roller 51 through the transfer belt 55.

The transfer bias of the polarity reversed from that of the toner is applied to the intermediate transfer rollers 53 and the secondary transfer roller 56. The toner image, as formed on the surface of the photoreceptor 11, is transferred to the surface of the intermediate transfer belt 52. The toner images, as formed with the individual toners of the yellow, magenta, cyan and black colors, are sequentially superposed and transferred onto the intermediate transfer belt 52 thereby to form a full-color toner image. The toner image, as formed on the intermediate transfer belt 52, is transferred onto the sheet of recording paper, as transferred at the adjusted timing between the driven roller 51 and the secondary transfer roller 56, by the secondary transfer section 54 acting like that intermediate transfer belt 52.

The cleaning section 17K, as shown in FIG. 2, is constituted to include a cleaning blade and a toner reserving container. The cleaning blade is a member for removing the toner residing on the surface of the photoreceptor 11K, after the toner image on the surface of the photoreceptor 11K was transferred to the intermediate transfer belt 52. The cleaning blade is pressed onto the surface of the photoreceptor 11K by a pressure mechanism (not shown) thereby to scrape out the residual toner on the surface of the photoreceptor 11K. The toner reserving container temporarily reserves the toner scraped out by the cleaning blade. The toner, as temporarily reserved in the toner reserving container, is discarded into a waste toner box 57 via a piping (not shown).

The sheet of recording paper having the toner image transferred thereto is conveyed to the fixing unit 5 by the transfer belt 55. The fixing unit 5 is constituted to include a heating roller heated to a predetermined temperature, and a pressure roller 5*b* pressed against the heating roller 5*a*. The sheet of recording paper having the toner image transferred thereto is heated and pressed, while passing through a nip portion formed by contact between the heating roller 5*a* and the pressure roller 5*b* under pressure, so that the sheet of recording paper has the toner image fixed thereon. The sheet of recording paper thus fixed is discharged to the paper discharge unit 6 by the not-shown paper discharge roller.

The paper feeding unit 4 is constituted to include a paper feeding cassette, a pickup roller and a plurality of sets of registration rollers. The paper feeding cassette houses the sheets of recording paper. The pickup roller feeds the sheets of recording paper one by one to a sheet transfer passage. The plurality of sets of registration rollers feed the sheet of recording paper to a transfer position or an abutment position, at which the intermediate transfer belt 52 and the secondary transfer roller 56 abut through the transfer belt 55, when the toner image on the intermediate transfer belt 52 is transferred to that transfer position. In the paper feeding unit 4, the sheets of recording paper, as housed in the paper feeding cassette, are fed one by one to the paper transfer passage by the pickup roller so that the sheet of recording paper is fed by the plural sets of registration rollers to the transfer position between the intermediate transfer belt 52 and the secondary transfer roller 56.

The whole actions relating to the image formation by the image forming apparatus 1 are briefly described in the following. For example, the image information, as read out by the image information reading unit 2, of the document is sent to and graphically processed by the image processing unit. The image information thus processed is fed to the exposure unit 13, in which the surface of the photoreceptor 11 charged to the uniform potential by the charger 12 is exposed to light so as to form the electrostatic latent image. This electrostatic latent image thus formed on the surface of the photoreceptor 11 is developed by the developing section 14 so that the toner image is formed on the surface of the photoreceptor 11.

At the transfer unit 16, the toner images, as formed on the surfaces of the photoreceptors 11 for the individual colors, are laminated and transferred in the order of the yellow toner image, the magenta toner image, the cyan toner image and the black toner image to the intermediate transfer belt 52 so that the full-color toner image is formed. After the toner images were transferred to the intermediate transfer belt 52, the toner, as might otherwise be left on the surfaces of the photoreceptors 11, is removed by the cleaning section 17. The full-color image, as formed on the intermediate transfer belt 52, is transferred to the sheet of recording paper being transferred between the driven roller 51 and the secondary transfer roller 56.

The sheet of recording paper having the toner image transferred thereto is passed through the nip portion between the heating roller 5*a* and the pressure roller 5*b* at the fixing unit so that the toner image is fixed. The sheet of recording paper having the fixed image is discharged to the paper discharge unit 6 so that the series image forming actions are ended.

In this procedure of image forming actions, the motor 9 for rotating the toner cartridge 8 of the color is activated by the control section 7, when the toner density for that color in the developer container 15 reduces, thereby to supply the developer container 15 with that toner.

Here, it is assumed that the developer container 15 to be supplied with the toner is the developer container 15K for the black image to be supplied with the toner from either of the two toner cartridges 8K1 and 8K2. In response to the toner remaining amount detection information transmitted to the communication device 48, the control section 7 drives either of the motor 9K1 and the motor 9K2 so that the toner may be supplied from the toner cartridge 8 having the less toner remaining amount.

As a result, the toner can be preferentially supplied from the toner cartridge 8 of the least toner remaining amount to the developer container 15. Even in case, therefore, the toner cartridge before the end of use is employed at the time of replacement in place of an unused toner cartridge, for example, the toner cartridge before the end of use and to be earlier used can be preferentially employed without interrupting the image forming actions. This makes it possible to prevent the toner cartridge before the end of use from being degraded in the charging characteristics and fluidity of the toner, as might otherwise be caused after left unused for a long time, so that an image of high quality can always be formed.

The image forming apparatus 1 thus far described can be modified in various manners without being limited to the foregoing constitutions.

In this embodiment, the accumulated value of the number of rotations is transmitted as the toner remaining amount detection information from the wireless IC tag 27 to the control section 7 so that the remaining amount of the toner is calculated in the control section 7 from that accumulated value of the number of rotations. That is, the control section 7 serves as a remaining amount calculating section. However, the invention should not be limited thereto but may be modified such that the toner remaining amount is calculated in the wireless IC tag from the accumulated value of the number of rotations by Equation (1) and such that the calculated result is transmitted as the toner remaining amount detection information to the control section 7. That is, the wireless IC tag serves as the remaining amount calculating section. In the case of this modified constitution, the wireless IC tag used is prestored with both the initial value of the toner quantity to be stored at the time of manufacturing the toner cartridge and the toner discharge for one rotation of the toner cartridge 8, and further includes a remaining amount calculating section for calculating the remaining amount of the toner to be contained in the toner cartridge, from the accumulated value of the number of rotations, as detected by the rotating meter 44, of the toner cartridge.

Moreover, the toner remaining amount detecting section for detecting the remaining amount of the toner cartridge 8 should not be limited to the constitution using the wireless IC tag as the wireless transmitting/receiving section, but may be modified such that the toner remaining amount detection information is transmitted to the control section by a wired transmitting/receiving section. However, the employment of the wireless IC tag which is the wireless transmitting/receiving section, as described in this embodiment, is preferred, because the arrangement of the toner cartridge and the control section can be freely set to spare the space for the apparatus.

Moreover, the toner remaining amount detecting section should not be limited to the wireless IC tag belonging to each toner cartridge, i.e., the wireless IC tag having the IC chip unit which is the nonvolatile memory.

The constitution, in which the toner cartridge is not equipped with the wireless IC tag, is exemplified such that a toner weight sensor is used as the toner remaining amount detecting section. This toner weight sensor as the toner remaining amount detecting section is so disposed below each of the toner cartridges as to detect the weight of the toner cartridge. Moreover, the control section is prestored with the weight of the container of the toner cartridge. The weight, as detected by the toner weight sensor, of the toner cartridge is inputted to the control section by wired or wireless connections. This constitution can detect the remaining amount of the toner in the toner cartridge from both the detection result of the toner weight sensor and the prestored weight of the container of the toner cartridge.

Another constitution, in which the toner cartridge is not equipped with the wireless IC tag, is exemplified by using a position sensor as the toner remaining amount detecting section. In the image forming apparatus thus constituted, a spring member is arranged below each toner cartridge so that the toner cartridge is disposed on the spring member. When the toner cartridge is charged with the toner, the toner cartridge is sunk by the weight of the toner while compressing and deforming the spring member. As the toner is consumed the more, the entire weight of the toner cartridge becomes the lighter so that the position of the toner cartridge is displaced upward by the repulsive force, i.e., the elongating deformation of the spring member. Moreover, this image forming apparatus is equipped as the toner remaining amount detecting section with a position sensor for detecting a displacement amount of the toner cartridge which is displaced in position with the change in the remaining amount of the toner contained in the toner cartridge. At the same time, table data is stored in the control section in advance. In the table data, the displacement amount of the toner cartridge which amount is detected by the position sensor, and the remaining amount of the toner in the toner cartridge are associated with each other. The displacement amount of the toner cartridge which amount is detected by the position sensor, is inputted to the control section by wired or wireless connections. In this constitution, the remaining amount of the toner in the toner cartridge can be detected from the displacement amount of the toner cartridge.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus comprising:

a developing section for developing with toner contained in a developer container;

a plurality of toner cartridges for containing toners of an identical color;

a toner supply section for supplying the toner from the toner cartridges to the developer container;

a toner remaining amount detecting section for detecting individual remaining amounts of the toners contained in the toner cartridges; and a control section for controlling the toner supply section to select the toner cartridge having the least toner remaining amount detected by the toner remaining amount detecting section, and to supply the toner from the selected toner cartridge to the developer container.

2. The image forming apparatus of claim 1, wherein the toner remaining amount detecting section is disposed in each of the toner cartridges, and the toner remaining amount detecting section includes a nonvolatile memory in which toner remaining amount detection information which is information on the remaining amount of the toner contained in the toner cartridge, is stored.

3. The image forming apparatus of claim 2, wherein the toner remaining amount detecting section includes a first wireless transmitting/receiving section for transmitting the toner remaining amount detection information stored in the nonvolatile memory, to an outside, and the control section includes a second wireless transmitting/receiving section for receiving the toner remaining amount detection information transmitted from the first wireless transmitting/receiving section, thereby to control the toner supply section in accordance with the toner remaining amount detection information obtained by the second wireless transmitting/receiving section.

4. The image forming apparatus of claim 1, wherein the toner supply section includes a plurality of motors that function as rotational drive sections which are operably connected to each of the toner cartridges, for rotating each respective toner cartridge to supply the toner.

5. The image forming apparatus of claim 4, wherein the toner cartridge includes a rotation number detecting unit for detecting a number of rotations of the toner cartridge, wherein the accumulated value of the number of rotations of the toner cartridge which number of rotations is detected by the rotation number detecting unit, is stored as the toner remaining amount detection information in the nonvolatile memory.

6. The image forming apparatus of claim 4, wherein the toner cartridge includes a rotation number detecting unit for detecting a number of rotations of the toner cartridge, and a remaining amount calculating section for calculating the remaining amount of the toner reserved in the toner cartridge, from the accumulated value of the number of rotations of the toner cartridge which number of rotations is detected by the rotation number detecting unit, wherein the toner remaining amount calculated by the remaining amount calculating section is stored as the toner remaining amount detection information in the nonvolatile memory.

* * * * *